US010598169B2

(12) United States Patent
Chen et al.

(10) Patent No.: US 10,598,169 B2
(45) Date of Patent: Mar. 24, 2020

(54) FLUID TRANSPORTATION DEVICE COMPRISING A VALVE BODY, A VALVE MEMBRANE, A VALVE CHAMBER SEAT, AND AN ACTUATOR EACH SEQUENTIALLY STACKED WITHIN A ACCOMMODATION SPACE OF AN OUTER SLEEVE HAVING A RING-SHAPED PROTRUSION STRUCTURE

(71) Applicant: Microjet Technology Co., Ltd., Hsinchu (TW)

(72) Inventors: Shou-Hung Chen, Hsinchu (TW); Shih-Chang Chen, Hsinchu (TW); Hung-Hsin Liao, Hsinchu (TW); Chi-Feng Huang, Hsinchu (TW); Chang-Yen Tsai, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 234 days.

(21) Appl. No.: 15/896,396

(22) Filed: Feb. 14, 2018

(65) Prior Publication Data

US 2018/0245577 A1 Aug. 30, 2018

(30) Foreign Application Priority Data

Feb. 24, 2017 (TW) ..... 106106428 A

(51) Int. Cl.
*F04B 43/04* (2006.01)
*F04B 43/02* (2006.01)
(Continued)

(52) U.S. Cl.
CPC ..... *F04B 43/046* (2013.01); *F04B 43/009* (2013.01); *F04B 43/0054* (2013.01);
(Continued)

(58) Field of Classification Search
CPC .. F04B 43/046; F04B 43/0054; F04B 43/009; F04B 43/025; F04B 53/10; F04B 53/102;
(Continued)

(56) References Cited

U.S. PATENT DOCUMENTS 4,181,477 A * 1/1980 Litt ..... F04B 53/1092 137/512.15
5,205,819 A * 4/1993 Ross ..... A61M 5/14224 128/DIG. 12
(Continued)

FOREIGN PATENT DOCUMENTS

CN 101581291 A 11/2009
CN 101634292 A 1/2010
(Continued)

*Primary Examiner* — Devon C Kramer
*Assistant Examiner* — Benjamin Doyle
(74) *Attorney, Agent, or Firm* — Birch, Stewart, Kolasch & Birch, LLP

(57) ABSTRACT

A fluid transportation device includes a valve body, a valve membrane, a valve chamber seat, an actuator and an outer sleeve. The valve body includes an inlet passage and an outlet passage. The valve chamber seat includes an inlet valve channel, an outlet valve channel and a pressure chamber. The pressure chamber is in communication with the inlet valve channel and the outlet valve channel. The valve membrane is arranged between the valve body and the valve chamber seat. The valve membrane includes two valve plates. The inlet valve channel and the outlet valve channel are closed by the two valve plates. The pressure chamber is covered by the actuator. The outer sleeve has an accommodation space. A ring-shaped protrusion structure is formed on the inner wall of the outer sleeve. Moreover, plural engaging structures are discretely arranged on a periphery of the outer sleeve.

8 Claims, 10 Drawing Sheets

(51) Int. Cl.
*F04B 43/00* (2006.01)
*F04B 53/10* (2006.01)
*F04B 53/16* (2006.01)

(52) U.S. Cl.
CPC ..... *F04B 43/025* (2013.01); *F04B 53/10* (2013.01); *F04B 53/1087* (2013.01); *F04B 53/16* (2013.01)

(58) Field of Classification Search
CPC ..... F04B 53/1087; F04B 53/16; F16B 2200/503; F16B 2200/50; Y10T 403/4941; Y10T 403/49
USPC ..... 417/413.2, 384, 413.1, 395, 266
See application file for complete search history.

(56) References Cited

U.S. PATENT DOCUMENTS 5,499,909 A * 3/1996 Yamada ..... F04B 43/043 417/266
6,589,229 B1 * 7/2003 Connelly ..... A61M 5/14248 604/890.1
7,284,966 B2 * 10/2007 Xu ..... F04B 19/006 417/395
7,485,263 B2 * 2/2009 Husar ..... B01L 3/0268 422/105
8,484,869 B2 * 7/2013 Lukas ..... D06F 75/14 38/77.8
8,579,606 B2 * 11/2013 Chen ..... F04B 43/043 137/856
9,145,882 B2 * 9/2015 Kim ..... F04B 43/043
9,375,562 B2 * 6/2016 Holtwick ..... A61M 5/16827
10,359,036 B2 * 7/2019 Chen ..... F04B 53/16
2004/0016111 A1 * 1/2004 Mueller ..... B23P 19/062 29/700
2006/0245947 A1 * 11/2006 Seto ..... F04B 17/003 417/410.1
2007/0267940 A1 * 11/2007 Wright ..... F04B 43/04 310/311
2009/0060750 A1 * 3/2009 Chen ..... F04B 43/043 417/26
2009/0159830 A1 * 6/2009 Chen ..... F04B 43/0009 251/356
2009/0196778 A1 * 8/2009 Kitahara ..... F04B 11/0016 417/540
2009/0232680 A1 * 9/2009 Kitahara ..... F04B 43/0054 417/413.2
2009/0242060 A1 * 10/2009 Chen ..... F04B 43/043 137/814
2009/0242061 A1 * 10/2009 Chen ..... F04B 53/106 137/833
2010/0074775 A1 * 3/2010 Yamamoto ..... F04B 43/028 417/413.2
2011/0296722 A1 * 12/2011 Lukas ..... D06F 75/14 38/77.1
2013/0331823 A1 * 12/2013 Askem ..... F04B 45/047 604/543
2018/0209409 A1 * 7/2018 Liao ..... F04B 43/046
2018/0209410 A1 * 7/2018 Chen ..... F04B 53/16
2018/0209411 A1 * 7/2018 Chen ..... F04B 53/16
2018/0223829 A1 * 8/2018 Tanaka ..... F04B 45/04

FOREIGN PATENT DOCUMENTS

CN 202628461 U 12/2012
CN 205977588 U 2/2017
JP 59-200083 A 11/1984

* cited by examiner

FLUID TRANSPORTATION DEVICE COMPRISING A VALVE BODY, A VALVE MEMBRANE, A VALVE CHAMBER SEAT, AND AN ACTUATOR EACH SEQUENTIALLY STACKED WITHIN A ACCOMMODATION SPACE OF AN OUTER SLEEVE HAVING A RING-SHAPED PROTRUSION STRUCTURE

FIELD OF THE INVENTION

The present invention relates to a fluid transportation device, and more particularly to a fluid transportation device for use in a micro pump.

BACKGROUND OF THE INVENTION

Nowadays, fluid transportation devices used in many sectors such as pharmaceutical industries, computer techniques, printing industries, energy industries are developed toward miniaturization. The fluid transportation devices used in for example micro pumps, micro atomizers, printheads or industrial printers are very important components. Consequently, it is critical to improve the fluid transportation devices.

FIG. 9A is a schematic cross-sectional view illustrating a micro pump in a non-actuation status. The micro pump 7 comprises an inlet passage 73, a micro actuator 75, a transmission block 74, a diaphragm 72, a compression chamber 711, a substrate 71 and an outlet passage 76. The compression chamber 711 is defined between the diaphragm 72 and the substrate 71 for storing a fluid therein. Depending on the deformation amount of the diaphragm 72, the capacity of the compression chamber 711 is varied.

When a voltage is applied on both electrodes of the micro actuator 75, an electric field is generated. In response to the electric field, the micro actuator 75 is subjected to a downward deformation. Consequently, the micro actuator 75 is moved toward the diaphragm 72 and the compression chamber 711. Since the micro actuator 75 is disposed on the transmission block 74, the pushing force generated by the micro actuator 75 is transmitted to the diaphragm 72 through the transmission block 74. In response to the pushing force, the diaphragm 72 is subjected to a compressed deformation. Please refer to FIG. 9B. The fluid flows in the direction indicated as the arrow X. After the fluid is introduced into the inlet passage 73 and stored in the compression chamber 711, the fluid within the compression chamber 711 is pushed in response to the compressed deformation. Consequently, the fluid will flow to a predetermined vessel (not shown) through the outlet passage 76. In such way, the fluid can be continuously supplied.

FIG. 9C is a schematic top view of the micro pump shown in FIG. 9A. When the micro pump 7 is actuated, the fluid is transported in the direction indicated as the arrow Y. The micro pump 7 has an inlet flow amplifier 77 and an outlet flow amplifier 78. The inlet flow amplifier 77 and the outlet flow amplifier 78 are cone-shaped. The larger end of the inlet flow amplifier 77 is connected to the inlet passage 731. The smaller end of the inlet flow amplifier 77 is connected to the compression chamber 711. The outlet flow amplifier 78 is connected with the compression chamber 711 and the outlet passage 761. The larger end of the outlet flow amplifier 78 is connected to the compression chamber 711. The smaller end of the outlet flow amplifier 78 is connected to the outlet passage 761. In other words, the inlet flow amplifier 77 and the outlet flow amplifier 78 are connected to the two ends of the compression chamber 711. The inlet flow amplifier 77 and the outlet flow amplifier 78 are arranged in the same direction. Due to the different flow resistances at both ends of the flow amplifiers and the volume expansion/compression of the compression chamber 711, a unidirectional net flow rate is rendered. That is, the fluid flows from the inlet passage 731 into the compression chamber 711 through the inlet flow amplifier 77 and then flows out of the outlet passage 761 through the outlet flow amplifier 78.

However, this valveless micro pump 7 still has some drawbacks. For example, a great amount of the fluid is readily returned back to the input channel when the micro pump is in the actuation status. For enhancing the net flow rate, the compression ratio of the compression chamber 711 should be increased to result in a sufficient chamber pressure. Under this circumstance, a costly micro actuator 75 is required.

For solving the drawbacks of the conventional technologies, the present invention provides a fluid transportation device for maintaining the working performance and the flowrate of the fluid.

SUMMARY OF THE INVENTION

An object of the present invention provides a fluid transportation device for transferring the fluid at high efficiency while preventing from the fluid leakage.

Another object of the present invention provides a fluid transportation device. It is not necessary to use the fastening elements (e.g., screws, nuts or bolts) to fasten the components of the fluid transportation device. Consequently, the fluid transportation device can be assembled more easily.

A further object of the present invention provides a fluid transportation device. After the valve body, the valve membrane, the valve chamber seat and the actuator are sequentially stacked on each other and accommodated within the outer sleeve, the engaging structures of the outer sleeve are engaged with the coupling structure of the valve body. Consequently, the combination of the valve body, the valve membrane, the valve chamber seat and the actuator is positioned in the outer sleeve. In other words, it is not necessary to use the fastening elements (e.g., screws, nuts or bolts) to fasten the components of the fluid transportation device. Consequently, the fluid transportation device can be assembled more easily. Moreover, the sealing rings are arranged around the inlet opening, the outlet opening, the inlet valve channel, the outlet valve channel and the pressure chamber to prevent from the fluid leakage. While the actuator is enabled, the volume of the pressure chamber is changed and the valve plate is selectively opened or closed. Consequently, the fluid can be transferred by the fluid transportation device at high efficiency without being returned back.

In accordance with an aspect of the present invention, there is provided a fluid transportation device. The fluid transportation device includes a valve body, a valve membrane, a valve chamber seat, an actuator and an outer sleeve. The valve body includes an inlet passage, an outlet passage, a first surface and a second surface. The inlet passage and the outlet passage run through the first surface and the second surface. An inlet opening is formed in the second surface and in communication with the inlet passage. An outlet opening is formed in the second surface and in communication with the outlet passage. A coupling structure is concavely formed in the first surface of the valve body. The valve membrane includes two valve plates, plural extension parts and plural hollow parts. The two valve plates have the same thickness. The plural extension parts are arranged around the valve plates for elastically supporting the valve plates. The hollow parts are arranged between the extension parts. The valve chamber seat includes a third surface, a fourth surface, an inlet valve channel, an outlet valve channel and a pressure chamber. The inlet valve channel and the outlet valve channel run through the third surface and the fourth surface. The two valve plates are respectively supported on the inlet valve channel and the outlet valve channel. The pressure chamber is concavely formed in the fourth surface and in communication with the inlet valve channel and the outlet valve channel. The pressure chamber of the valve chamber seat is covered by the actuator. An accommodation space is defined by an inner wall of the outer sleeve. A ring-shaped protrusion structure is formed on the inner wall of the outer sleeve. Moreover, plural engaging structures are discretely arranged on a periphery of the outer sleeve at regular intervals. The valve body, the valve chamber seat and the actuator are sequentially stacked on each other, accommodated within the accommodation space of the outer sleeve, and supported on the ring-shaped protrusion structure. The plural engaging structures of the outer sleeve are engaged with the coupling structure of the valve body.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
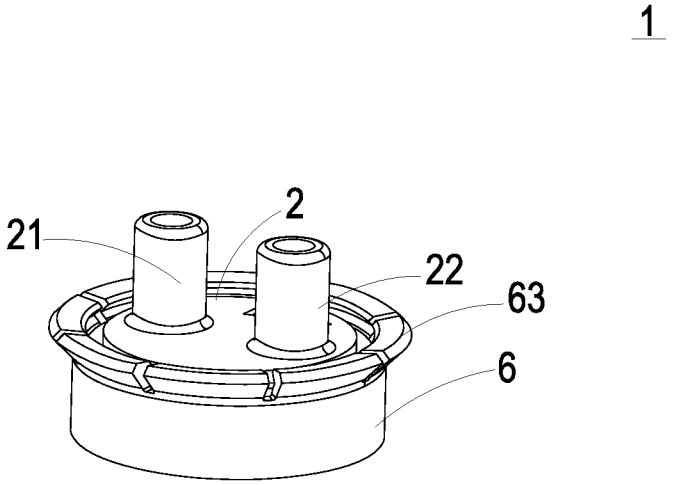
FIG. 1 is a schematic perspective view illustrating a fluid transportation device according to an embodiment of the present invention.
Figure 2A:
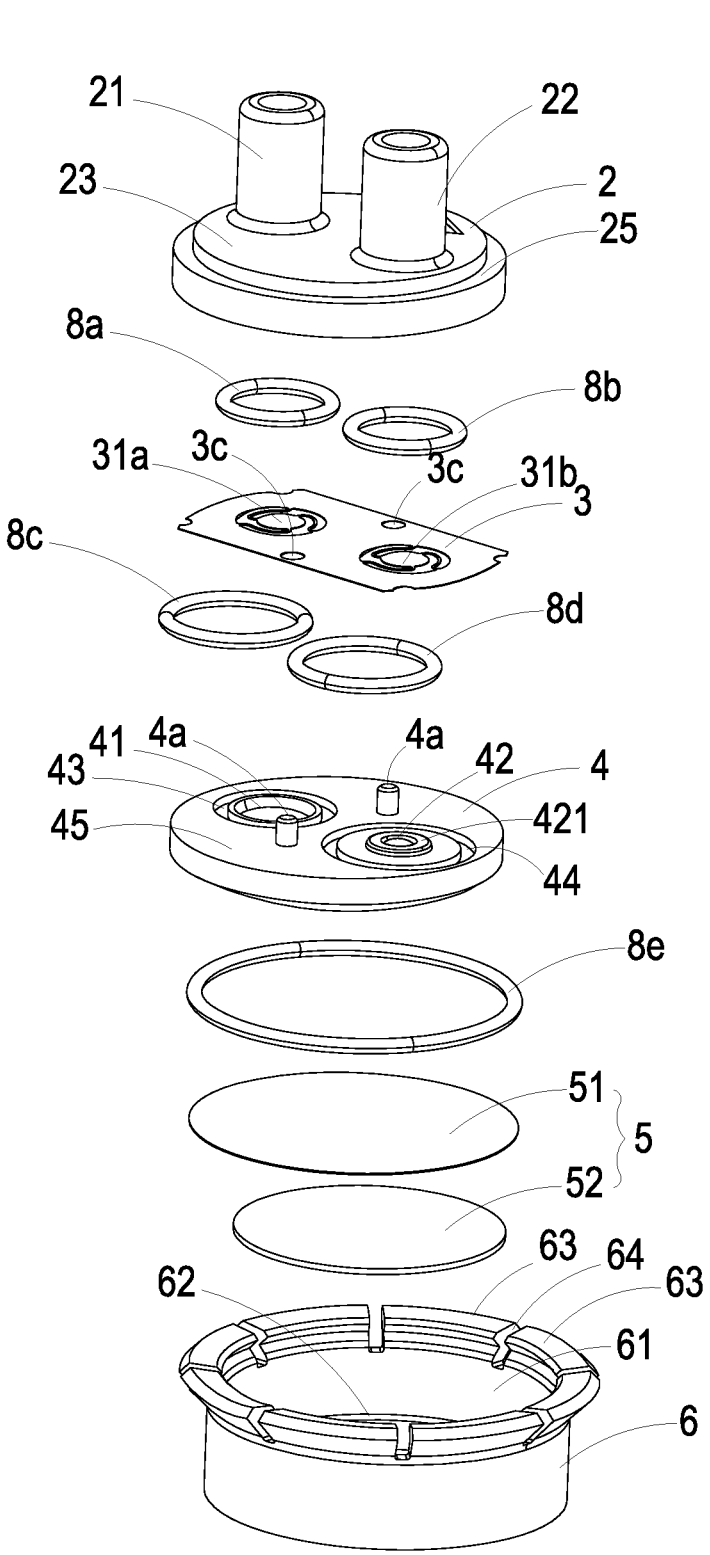
FIG. 2A is a schematic exploded view illustrating the fluid transportation device according to the embodiment of the present invention and taken along a front side.
Figure 2B:
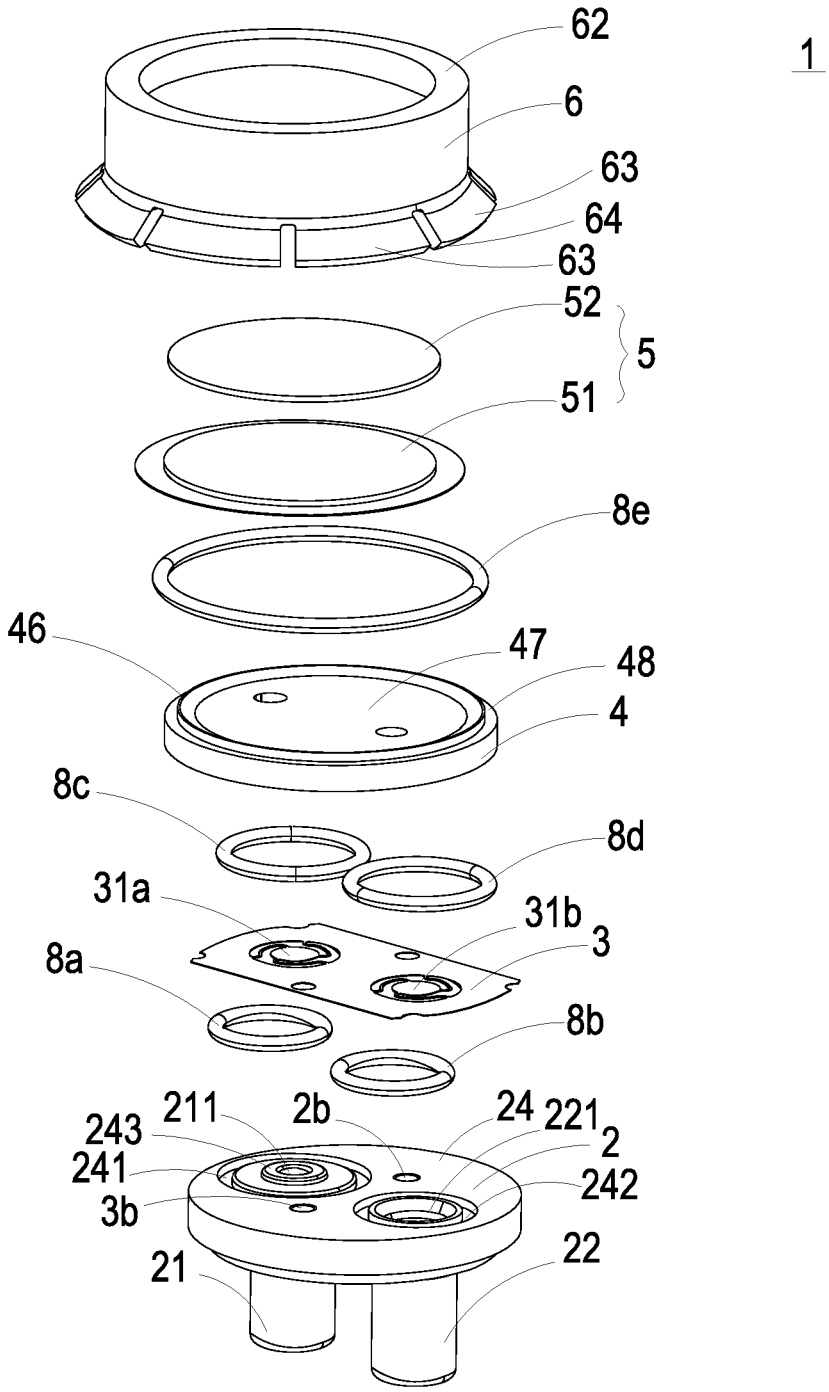
FIG. 2B is a schematic exploded view illustrating the fluid transportation device according to the embodiment of the present invention and taken along a rear side.
Figure 3A:
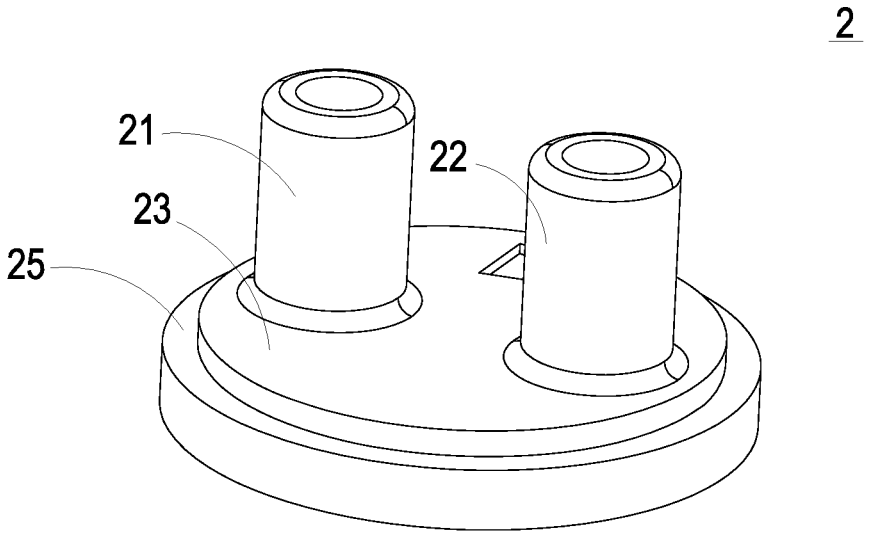
FIG. 3A is a schematic perspective view illustrating the valve body of the fluid transportation device according to the embodiment of the present invention and taken along the front side.
Figure 3B:
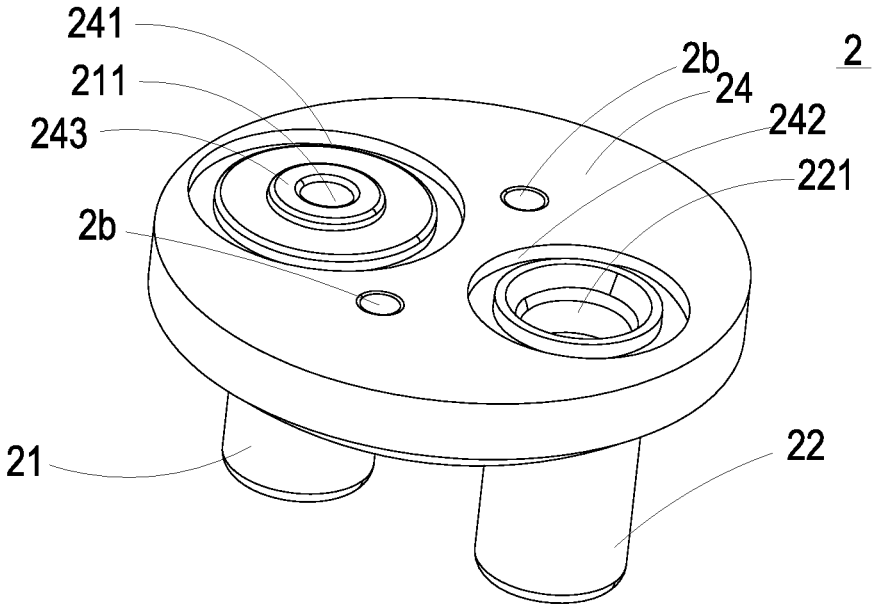
FIG. 3B is a schematic perspective view illustrating the valve body of the fluid transportation device according to the embodiment of the present invention and taken along the rear side.
Figure 4A:
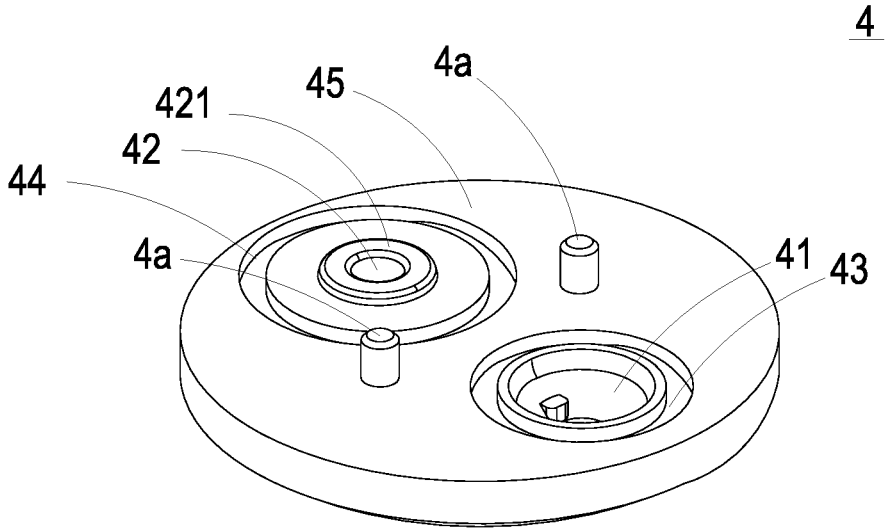
FIG. 4A is a schematic perspective view illustrating the valve chamber seat of the fluid transportation device according to the embodiment of the present invention and taken along the front side.
Figure 4B:
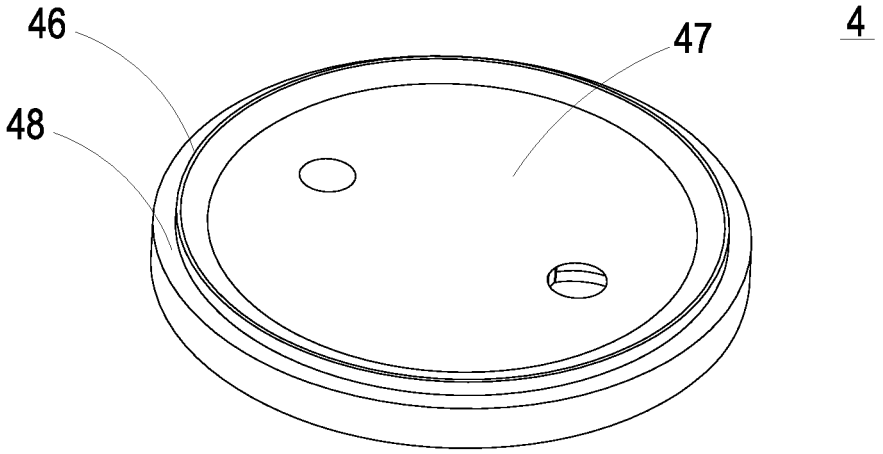
FIG. 4B is a schematic perspective view illustrating the valve chamber seat of the fluid transportation device according to the embodiment of the present invention and taken along the rear side.

Please refer to FIGS. 1, 2A and 2B. The fluid transportation device 1 of the present invention can be applied to many sectors such as pharmaceutical industries, computer techniques, printing industries or energy industries for transporting a fluid such as liquid, but the invention is not limited thereto. The fluid transportation device 1 comprises a valve body 2, a valve membrane 3, a valve chamber seat 4, an actuator 5 and an outer sleeve 6. The valve body 2, the valve membrane 3, the valve chamber seat 4 and the actuator 5 are sequentially stacked on each other, and accommodated within the outer sleeve 6. Then the outer sleeve 6 and the valve body 2 are engaged with each other, so as to make the fluid transportation device 1 to be positioned and assembled (shown in FIG. 1).

Please refer to FIGS. 1, 2A, 2B, 3A, 3B, 4A and 4B. The valve body 2 and the valve chamber seat 4 are the main components for guiding the fluid to be inputted into or outputted from the fluid transportation device 1. The valve body 2 comprises an inlet passage 21 and an outlet passage 22. The inlet passage 21 and the outlet passage 22 run through a first surface 23 and a second surface 24 of the valve body 2, respectively. An inlet opening 211 is formed in the second surface 24 and in communication with the inlet passage 21. Moreover, a groove 241 is formed in the second surface 24 and arranged around the inlet opening 211. A protrusion block 243 is disposed on the periphery of the inlet opening 211. An outlet opening 221 is formed in the second surface 24 and in communication with the outlet passage 22. A groove 242 is formed in the second surface 24 and arranged around the outlet opening 221. A coupling structure 25 is concavely formed in the first surface 23 of the valve body 2. Moreover, plural recesses 2*b* are formed in the second surface 24 of the valve body 2.

The valve chamber seat 4 comprises a third surface 45, a fourth surface 46, plural posts 4*a*, an inlet valve channel 41, an outlet valve channel 42 and a pressure chamber 47. The plural posts 4*a* are formed on the third surface 45. The posts 4*a* are aligned with the corresponding recesses 2*b* of the valve body 2. When the posts 4*a* are inserted into the corresponding recesses 2*b* of the valve body 2, the valve body 2 and the valve chamber seat 4 are combined together. The inlet valve channel 41 and the outlet valve channel 42 run through the third surface 45 and the fourth surface 46. A groove 43 is formed in the third surface 45 and arranged around the inlet valve channel 41. A protrusion block 421 is disposed on the periphery of the outlet valve channel 42. A groove 44 is formed in the third surface 45 and arranged around the outlet valve channel 42. The pressure chamber 47 is concavely formed in the fourth surface 46. The pressure chamber 47 is in communication with the inlet valve channel 41 and the outlet valve channel 42. Moreover, a concave structure 48 is formed in the fourth surface 46 and arranged around the pressure chamber 47.

Figure 5:
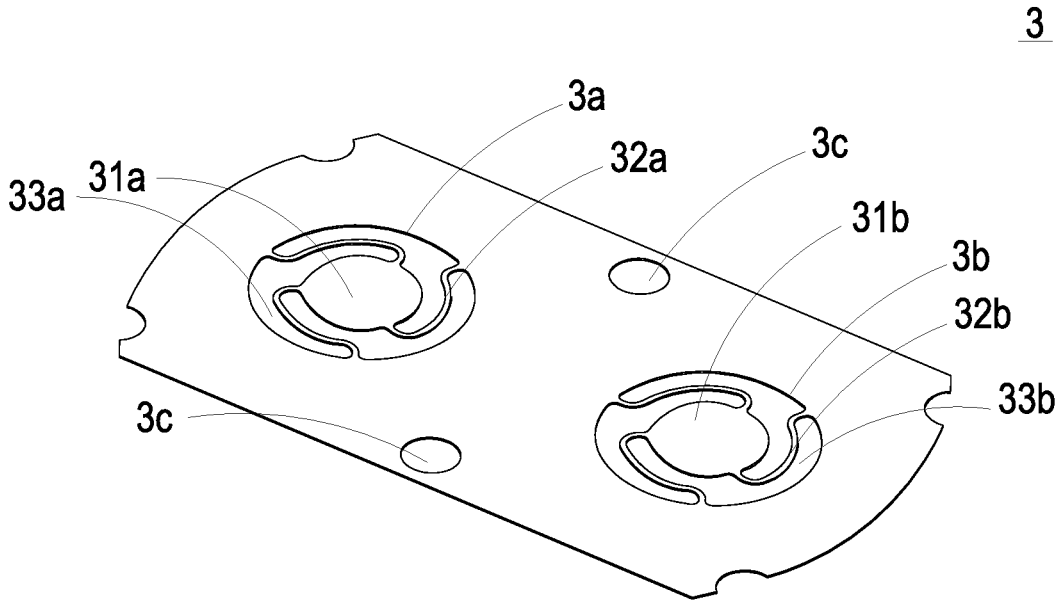
FIG. 5 is a schematic perspective view illustrating the valve membrane of the fluid transportation device according to the embodiment of the present invention.

Please refer to FIGS. 2A, 2B and 5. In an embodiment, the valve membrane 3 is made of polyimide (PI), and the valve membrane 3 is produced by a reactive ion etching (RIE) process. After a photosensitive photoresist is applied on the valve structure and the pattern of the valve structure is exposed and developed, the polyimide layer uncovered by the photoresist is etched so as to define the valve structure of the valve membrane 3. The valve membrane 3 is a flat thin film structure. As shown in FIG. 5, the valve membrane 3 comprises two valve plates 31*a* and 31*b* at two perforated regions 3*a* and 3*b*, respectively. The two valve plates 31*a* and 31*b* have the same thickness. The valve membrane 3 further comprises plural extension parts 32*a* and 32*b*. The extension parts 32*a* and 32*b* are arranged around the valve plates 31*a* and 31*b* for elastically supporting the valve plates 31*a* and 31*b*. The valve membrane 3 further comprises plural hollow parts 33*a* and 33*b*. The hollow parts 33*a* are arranged between the extension parts 32*a*. The hollow parts 33*b* are arranged between the extension parts 32*b*. When external forces are exerted on the valve plates 31*a* and 31*b* with the same thickness, the valve plates 31*a* and 31*b* are elastically supported by the extension parts 32*a* and 32*b* in order to result in displacements. Consequently, a valve structure is formed. Preferably but not exclusively, the valve plates 31*a* and 31*b* have circular shapes, rectangular shapes, square shapes or arbitrary shapes. The valve membrane 3 further comprises plural positioning holes 3*c*. The posts 4*a* of the valve chamber seat 4 are penetrated through the corresponding positioning holes 3*c*. Consequently, the valve membrane 3 is positioned and supported on the valve chamber seat 4. Meanwhile, the inlet valve channel 41 and the outlet valve channel 42 are respectively covered by the valve plates 31*a* and 31*b* (see FIG. 7). In this embodiment, the valve chamber seat 4 comprises two posts 4*a* and the valve membrane 3 comprises two positioning holes 3*c*. It is noted that the number of the posts 4*a* and the number of the positioning holes 3*c* are not restricted thereto.

Figure 7:
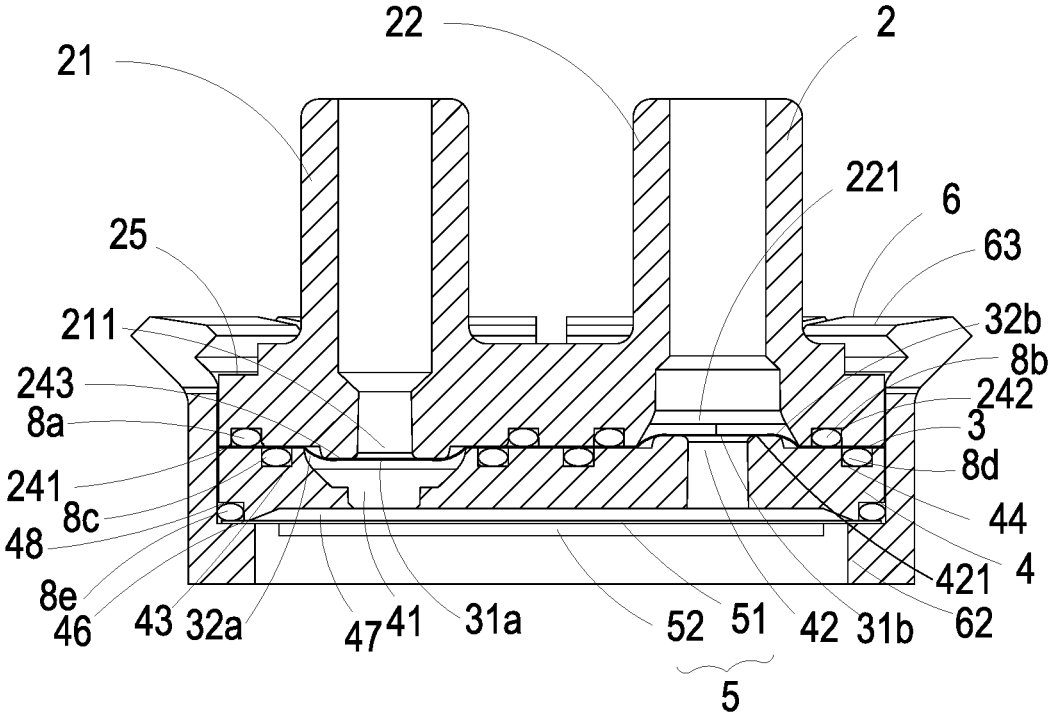
FIG. 7 is a schematic cross-sectional view illustrating the assembled structure of the fluid transportation device according to the embodiment of the present invention.

Please refer to FIG. 7. When the valve body 2 and the valve chamber seat 4 are combined together, four sealing rings 8*a*, 8*b*, 8*c* and 8*d* are received in the groove 241 of the valve body 2, the groove 242 of the valve body 2, the groove 43 of the valve chamber seat 4 and the groove 44 of the valve chamber seat 4, respectively. Due to the sealing rings 8*a*, 8*b*, 8*c* and 8*d*, the fluid is not leaked out. The inlet passage 21 of the valve body 2 is aligned with the inlet valve channel 41 of the valve chamber seat 4. The communication between the inlet passage 21 and the inlet valve channel 41 is selectively enabled or disabled through the valve plate 31*a* of the valve membrane 3. The outlet passage 22 of the valve body 2 is aligned with the outlet valve channel 42 of the valve chamber seat 4. The communication between the outlet passage 22 and the outlet valve channel 42 is selectively enabled or disabled through the valve plate 31*b* of the valve membrane 3. When the valve plate 31*a* of the valve membrane 3 is opened, the fluid is transferred from the inlet passage 21 to the pressure chamber 47 through the inlet valve channel 41. When the valve plate 31*b* of the valve membrane 3 is opened, the fluid is transferred from the pressure chamber 47 to the outlet passage 22 through the outlet valve channel 42. Finally, the fluid is expelled from the outlet passage 22.

Please refer to FIGS. 2A and 2B again. The actuator 5 comprises a vibration plate 51 and a piezoelectric plate 52. The piezoelectric plate 52 is attached on the surface of the vibration plate 51. In an embodiment, the vibration plate 51 is made of a metallic material, and the piezoelectric plate 52 is made of a highly-piezoelectric material such as lead zirconate titanate (PZT) piezoelectric powder. When a voltage is applied to the piezoelectric plate 52, the piezoelectric plate 52 is subjected to a deformation. Consequently, the vibration plate 51 is vibrated along the vertical direction in the reciprocating manner to drive the operation of the fluid transportation device 1. In this embodiment, the vibration plate 51 of the actuator 5 is assembled with the fourth surface 46 of the valve chamber seat 4 to cover the pressure chamber 47. As mentioned above, the concave structure 48 is formed in the fourth surface 46 and arranged around the pressure chamber 47. For preventing from the fluid leakage, a sealing ring 8*e* is received in the concave structure 48.

As mentioned above, the valve body 2, the valve membrane 3, the valve chamber seat 4 and the actuator 5 are the main components of the fluid transportation device 1 for guiding the fluid. In accordance with the feature of the present invention, the fluid transportation device 1 has a specified mechanism for assembling and positioning these components. That is, it is not necessary to use the fastening elements (e.g., screws, nuts or bolts) to fasten these components. In an embodiment, after the valve body 2, the valve membrane 3, the valve chamber seat 4 and the actuator 5 are sequentially stacked on each other and accommodated within the outer sleeve 6, the valve body 2 and the outer sleeve 6 are engaged with each other. Consequently, the fluid transportation device 1 is assembled. The mechanism for assembling and positioning these components will be described as follows.

Figure 6:
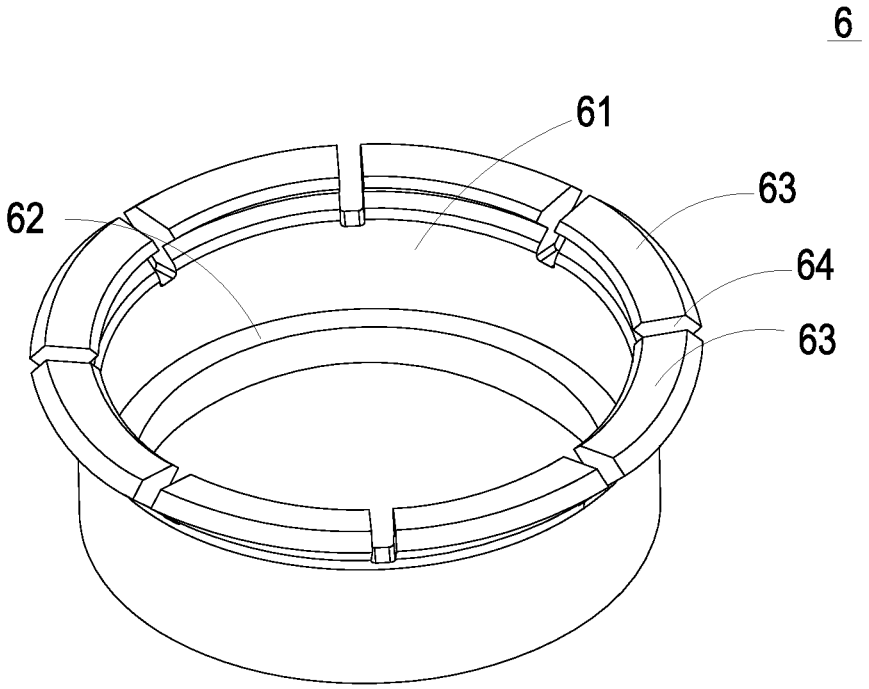
FIG. 6 is a schematic perspective view illustrating the outer sleeve of the fluid transportation device according to the embodiment of the present invention.

Please refer to FIGS. 2A, 2B and 6. The outer sleeve 6 is made of a metallic material. An accommodation space is defined by an inner wall 61 of the outer sleeve 6. Moreover, a ring-shaped protrusion structure 62 is formed on the lower portion of the inner wall 61 of the outer sleeve 6. Moreover, plural engaging structures 63 are discretely arranged on a periphery of the outer sleeve 6 at regular intervals. There is a separation slot 64 between every two adjacent engaging structures 63. Due to the separation slots 64, the engaging structures 63 arranged on the periphery of the outer sleeve 6 can be elastically pressed.

Please refer to FIG. 7 again. After the valve body 2, the valve membrane 3, the valve chamber seat 4 and the actuator 5 are sequentially stacked on each other, the combination of the valve body 2, the valve membrane 3, the valve chamber seat 4 and the actuator 5 is placed into the accommodation space within the inner wall 61 of the outer sleeve 6. While the combination of the valve body 2, the valve membrane 3, the valve chamber seat 4 and the actuator 5 is placed into the accommodation space of the outer sleeve 6, the engaging structures 63 of the outer sleeve 6 are pushed in the direction away from the outer sleeve 6. After the actuator 5 is supported on the ring-shaped protrusion structure 62 and the coupling structure 25 of the valve body 2 is aligned with the engaging structures 63 of the outer sleeve 6, the engaging structures 63 are restored to their original positions. Consequently, the engaging structures 63 are securely engaged with the coupling structure 25 of the valve body 2. Meanwhile, the fluid transportation device 1 is assembled. In this embodiment, the actuator 5 is also disposed within the accommodation space of the outer sleeve 6. When piezoelectric plate 52 is subjected to a deformation in response to the applied voltage, the vibration plate 51 is vibrated along the vertical direction in the reciprocating manner. In other words, it is not necessary to use the fastening elements (e.g., screws, nuts or bolts) to fasten the components of the fluid transportation device 1.

Please refer to FIG. 7 again. The inlet valve channel 41 of the valve chamber seat 4 is aligned with the inlet opening 211 of the valve body 2. The inlet valve channel 41 of the valve chamber seat 4 and the inlet opening 211 of the valve body 2 are selectively in communication with each other through the valve plate 31*a* of the valve membrane 3. When the inlet opening 211 of the valve body 2 is closed by the valve plate 31*a*, the valve plate 31*a* is in close contact with the protrusion block 243 of the valve body 2. Consequently, a pre-force is generated to result in a stronger sealing effect, and the fluid will not be returned back. The outlet valve channel 42 of the valve chamber seat 4 is aligned with the outlet opening 221 of the valve body 2. The outlet valve channel 42 of the valve chamber seat 4 and the outlet opening 221 of the valve body 2 are selectively in communication with each other through the valve plate 31*b* of the valve membrane 3. When the outlet valve channel 42 of the valve chamber seat 4 is closed by the valve plate 31*b*, the valve plate 31*b* is in close contact with the protrusion block 421 of the valve chamber seat 4. Consequently, a pre-force is generated to result in a stronger sealing effect, and the fluid will not be returned back to the pressure chamber 47. Consequently, in case that the fluid transportation device 1 is in a non-actuation status, the fluid is not returned back to the inlet passage 21 and the outlet passage 22 of the valve body 2.

Figure 8A:
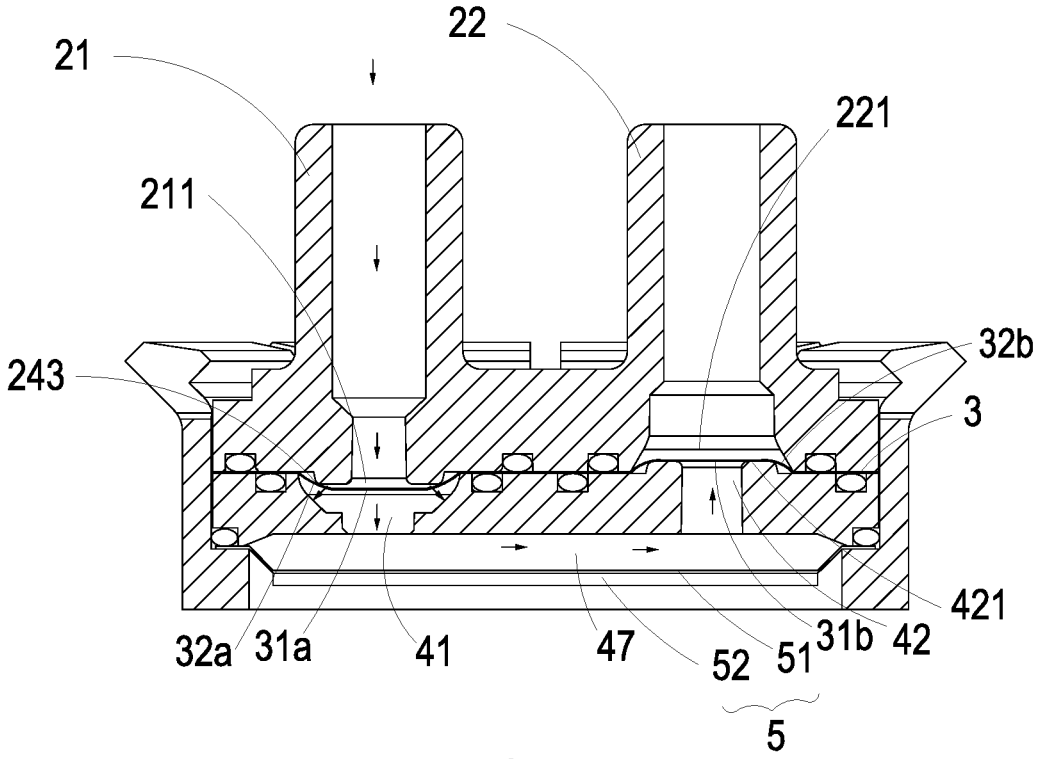
FIG. 8A is a schematic perspective view illustrating the operations of the fluid transportation device in a first situation.

The operations of the fluid transportation device 1 will be described in more details as follows. As shown in FIG. 8A, when the piezoelectric plate 52 of the actuator 5 is subjected to a deformation in response to the applied voltage and the vibration plate 51 is downwardly deformed, the volume of the pressure chamber 47 is expanded to result in suction. In response to the suction, the valve plate 31*a* of the valve membrane 3 is quickly opened. Consequently, a great amount of the fluid is inhaled into the inlet passage 21 of the valve body 2, and transferred to and temporarily stored in the pressure chamber 47 through the inlet opening 211 of the valve body 2, the hollow parts 33*a* of the valve membrane 3 and the inlet valve channel 41 of the valve chamber seat 4. Since the suction is also exerted on the outlet valve channel 42, the valve plate 31*b* is supported by the extension parts 32*b* of the valve membrane 3. Under this circumstance, the valve plate 31*b* is in close contact with the protrusion block 421 of the valve chamber seat 4. Consequently, the outlet valve channel 42 of the valve chamber seat 4 is closed.

Figure 8B:
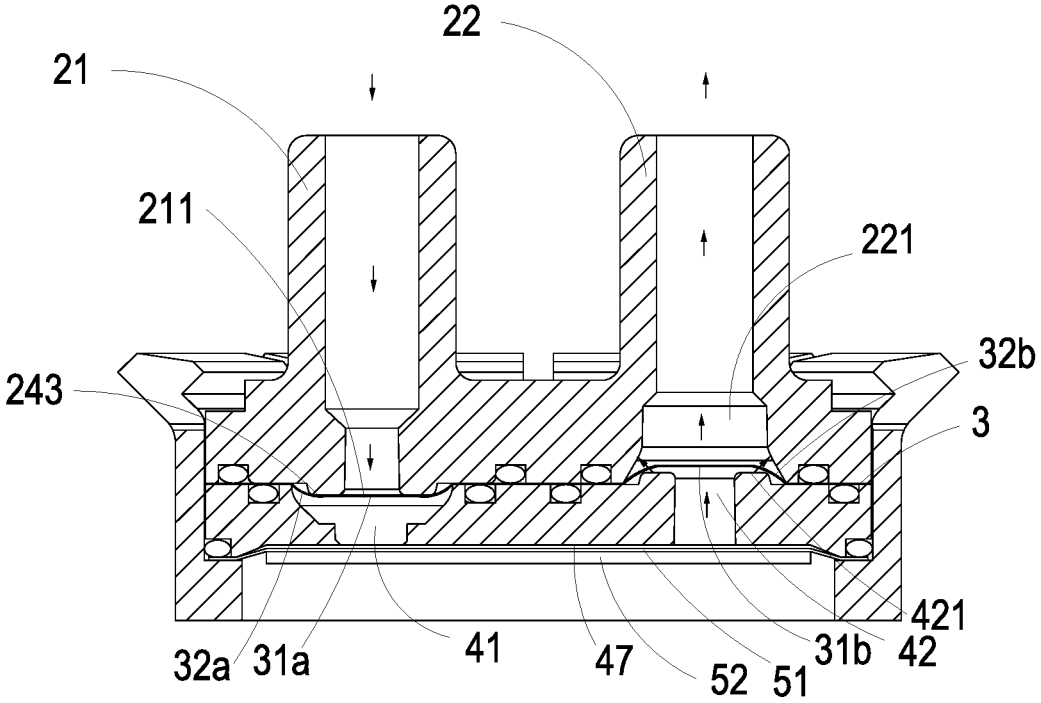
FIG. 8B is a schematic perspective view illustrating the operations of the fluid transportation device in a second situation.
Figure 9A:
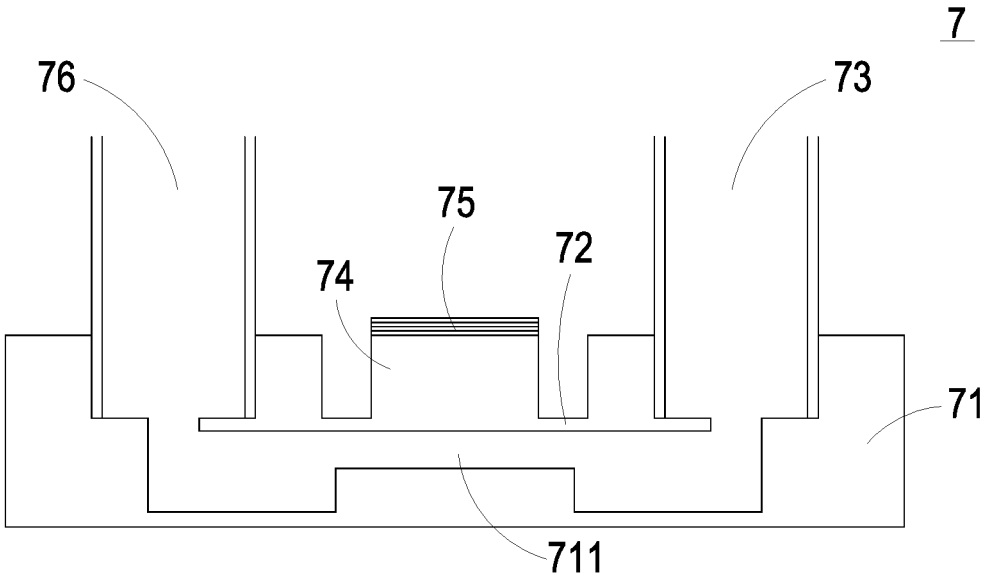
FIG. 9A PRIOR ART
FIG. 9A is a schematic cross-sectional view illustrating a micro pump in a non-actuation status.
Figure 9B:
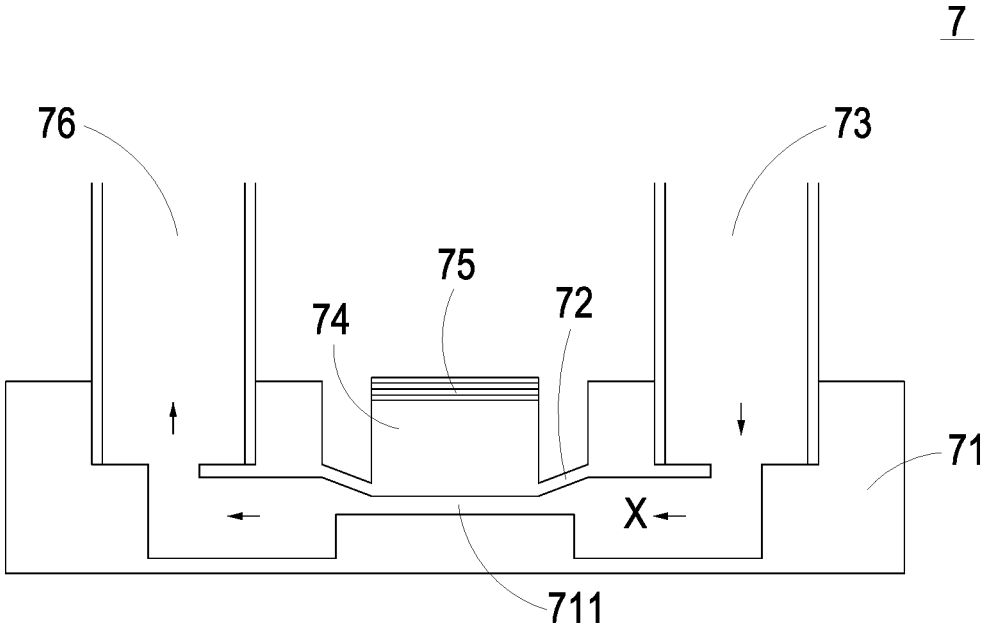
FIG. 9B PRIOR ART
FIG. 9B is a schematic cross-sectional view illustrating a micro pump in an actuation status.
Figure 9C:
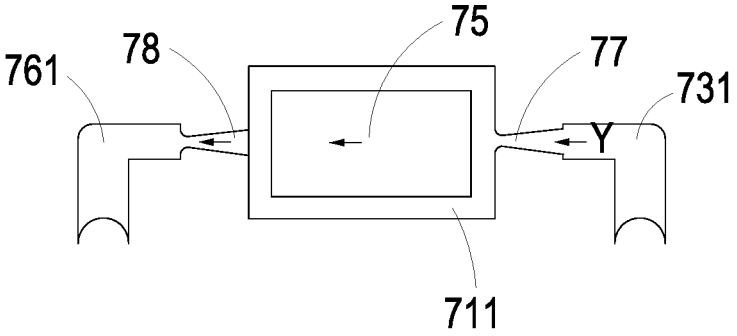
FIG. 9C PRIOR ART
FIG. 9C is a schematic top view of the micro pump shown in FIG. 9A.

Then, as shown in FIG. 8B, when the direction of electric field applied on the piezoelectric plate 52 is changed, the vibration plate 51 is upwardly deformed, and the volume of the pressure chamber 47 is shrunken. Meanwhile, the fluid within the pressure chamber 47 is compressed, and a pushing force is applied to the inlet valve channel 41. In response to the pushing force, the valve plate 31*b* is supported by the extension parts 32*a* of the valve membrane 3. Under this circumstance, the valve plate 31*a* is in close contact with the protrusion block 243 of the valve body 2. Consequently, the inlet valve channel 41 of the valve chamber seat 4 is closed, and the fluid cannot be returned back to the inlet valve channel 41. Meanwhile, the pushing force is also applied to the outlet valve channel 42. In response to the pushing force, the valve plate 31*b* is supported by the extension parts 32*b* of the valve membrane 3 and the valve plate 31*b* is separated from the protrusion block 421. Meanwhile, the outlet valve channel 42 of the valve chamber seat 4 is opened, and the fluid is transferred from the pressure chamber 47 to the external portion of the fluid transportation device 1 through the outlet valve channel 42 of the valve chamber seat 4, the hollow parts 33*b* of the valve membrane 3, the outlet opening 221 of the valve body 2 and the outlet passage 22 of the valve body 2. The processes of FIGS. 8A and 8B are repeatedly done. Consequently, the fluid can be transferred by the fluid transportation device 1 at high efficiency without being returned back.

From the above descriptions, the present invention provides the fluid transportation device. After the valve body, the valve membrane, the valve chamber seat and the actuator are sequentially stacked on each other and accommodated within the outer sleeve, the engaging structures of the outer sleeve are engaged with the coupling structure of the valve body. Consequently, the combination of the valve body, the valve membrane, the valve chamber seat and the actuator is positioned in the outer sleeve. In other words, it is not necessary to use the fastening elements (e.g., screws, nuts or bolts) to fasten the components of the fluid transportation device. Consequently, the fluid transportation device can be assembled more easily. Moreover, the sealing rings are arranged around the inlet opening, the outlet opening, the inlet valve channel, the outlet valve channel and the pressure chamber to prevent from the fluid leakage. While the actuator is enabled, the volume of the pressure chamber is changed and the valve plate is selectively opened or closed. Consequently, the fluid can be transferred by the fluid transportation device at high efficiency without being returned back. In other words, the fluid transportation device is industrially valuable.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fluid transportation device, comprising:

a valve body comprising an inlet passage, an outlet passage, a first surface and a second surface, wherein the inlet passage and the outlet passage run through the first surface and the second surface, an inlet opening is formed in the second surface and in communication with the inlet passage, an outlet opening is formed in the second surface and in communication with the outlet passage, and a coupling structure is concavely formed in the first surface of the valve body;

a valve membrane comprising two valve plates, plural extension parts and plural hollow parts, wherein the two valve plates have the same thickness, the plural extension parts are arranged around the valve plates for elastically supporting the valve plates, and the hollow parts are arranged between the extension parts;

a valve chamber seat comprising a third surface, a fourth surface, an inlet valve channel, an outlet valve channel and a pressure chamber, wherein the inlet valve channel and the outlet valve channel run through the third surface and the fourth surface, the two valve plates are respectively supported on the inlet valve channel and the outlet valve channel so as to form a valve structure, the pressure chamber is concavely formed in the fourth surface, and in communication with the inlet valve channel and the outlet valve channel;

an actuator, wherein the pressure chamber of the valve chamber seat is covered by the actuator; and an outer sleeve, wherein an accommodation space is defined by an inner wall of the outer sleeve, a ring-shaped protrusion structure is formed on the inner wall of the outer sleeve, and plural engaging structures are discretely arranged on a periphery of the outer sleeve at regular intervals, wherein the valve body, the valve chamber seat and the actuator are sequentially stacked on each other, accommodated within the accommodation space of the outer sleeve, and supported on the ring-shaped protrusion structure, wherein the plural engaging structures of the outer sleeve are engaged with the coupling structure of the valve body so as to form the fluid transportation device.

2. The fluid transportation device according to claim 1, wherein every two adjacent engaging structures of the outer sleeve are separated from each other through a separation slot so that the engaging structures arranged on the periphery of the outer sleeve are capable of being elastically pressed.

3. The fluid transportation device according to claim 1, wherein plural recesses are formed in the second surface of the valve body, and plural posts are formed on the third surface of the valve chamber seat, wherein the plural posts are inserted into the corresponding recesses, so that the valve chamber seat is fixed on the valve body.

4. The fluid transportation device according to claim 3, wherein the valve membrane is arranged between the valve body and the valve chamber seat, and the valve membrane comprises plural positioning holes corresponding to the plural posts, wherein the plural posts are penetrated through the corresponding positioning holes, so that the valve membrane is positioned and supported on the valve chamber seat.

5. The fluid transportation device according to claim 1, wherein a first groove is formed in the second surface and arranged around the inlet opening, a second groove is formed in the second surface and arranged around the outlet opening, a third groove is formed in the third surface and arranged around the inlet valve channel, and a fourth groove is formed in the third surface and arranged around the outlet valve channel, wherein the fluid transportation device further comprises plural sealing rings, and the plural sealing rings are received in the first groove, the second groove, the third groove and the fourth groove respectively so as to prevent from the fluid leakage.

6. The fluid transportation device according to claim 1, wherein a first protrusion block is formed on the second surface of the valve body and disposed on a periphery of the inlet opening, and a second protrusion block is formed on the third surface of the valve chamber seat and disposed on a periphery of the outlet valve channel, wherein the first protrusion block and the second protrusion block are in close contact with the valve plates respectively and a pre-force is generated to result in a sealing effect to prevent a fluid from returning back.

7. The fluid transportation device according to claim 1, wherein the actuator comprises a vibration plate and a piezoelectric plate, wherein the piezoelectric plate is attached on a surface of the vibration plate, the piezoelectric plate is subjected to a deformation in response to an applied voltage, and the vibration plate of the actuator is assembled with the fourth surface of the valve chamber seat to cover the pressure chamber.

8. The fluid transportation device according to claim 1, wherein the valve chamber seat further comprises a concave structure, wherein the concave structure is formed in the fourth surface of the valve chamber seat and arranged around the pressure chamber, and a sealing ring is received in the concave structure so as to prevent from the fluid leakage around a periphery of the pressure chamber.

* * * * *